United States Patent [19]

Pettersen

[11] 4,173,297

[45] Nov. 6, 1979

[54] NON-THROTTLING MANUALLY RECIPROCATED PLUNGER PUMP FOR CONSUMER-TYPE LIQUID DISPENSING CONTAINERS

[75] Inventor: Edward A. Pettersen, Waterbury, Conn.

[73] Assignee: The Risdon Manufacturing Company, Naugatuck, Conn.

[21] Appl. No.: 882,321

[22] Filed: Mar. 1, 1978

Related U.S. Application Data

[63] Continuation-in-part of Ser. No. 873,358, Jan. 30, 1978, abandoned.

[51] Int. Cl.[2] ..... B05L 11/02

[52] U.S. Cl. ..... 222/321; 222/380; 222/325

[58] Field of Search ..... 222/321, 380, 385; 239/331, 333

[56] References Cited

U.S. PATENT DOCUMENTS

| | | | |
|---|---|---|---|
| 3,583,605 | 6/1971 | Corsette | 222/321 |
| 3,627,206 | 12/1971 | Boris | 222/321 X |
| 3,949,906 | 4/1976 | Pettersen | 222/321 X |
| 4,025,046 | 5/1977 | Boris | 239/333 |

*Primary Examiner*—David A. Scherbel
*Assistant Examiner*—Frederick R. Handren
*Attorney, Agent, or Firm*—St. Onge, Steward, Johnston, Reens & Noë

[57] ABSTRACT

There is disclosed a non-throttling, anti-leak, manually reciprocated, plunger pump for attachment to a consumer-type liquid dispensing container to provide drip-free dispensing of liquid therefrom. The pump has a hollow-stemmed skirted plunger which is reciprocable in a pump chamber to draw liquid through an inlet into the chamber from a container, and to discharge it from the chamber to atmosphere through the hollow stem of the plunger. A check valve is positioned in the chamber inlet to allow liquid to enter but prevent its return flow. A differential force-actuated control element is nested in the plunger, for reciprocation therewith but having capability for axial movement independently thereof. The control element includes valve means for blocking discharge through the plunger stem and the valve is normally biased to blocking position. In addition the control element cooperates with a fitment or body insert at the inlet end of the pump chamber to provide telescopingly cooperating cylinder and piston members which are engaged throughout full reciprocal travel of the plunger and control valve. The fitment includes separate passages for venting the cylinder/piston combination to the interior of the container through an aperture in the wall of the pump housing, and for communicating the pump chamber with the fluid inlet and dip tube of the pump housing. The arrangement facilitates quick priming, and good maintenance of prime once established, of the pump.

10 Claims, 9 Drawing Figures

Fig. 1.
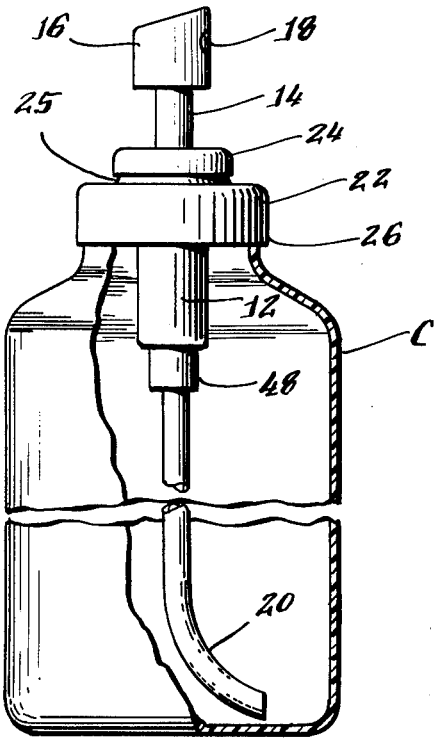
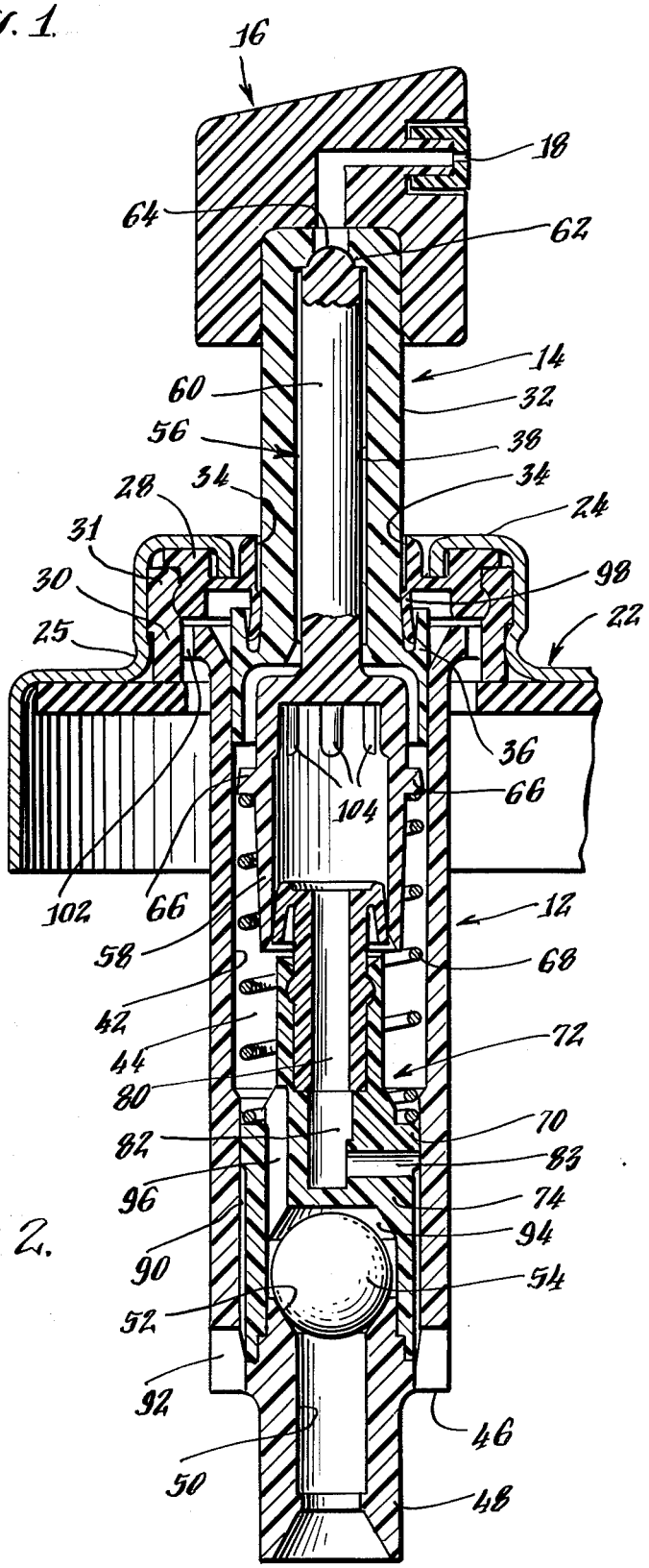
Fig. 2.

Fig. 6.
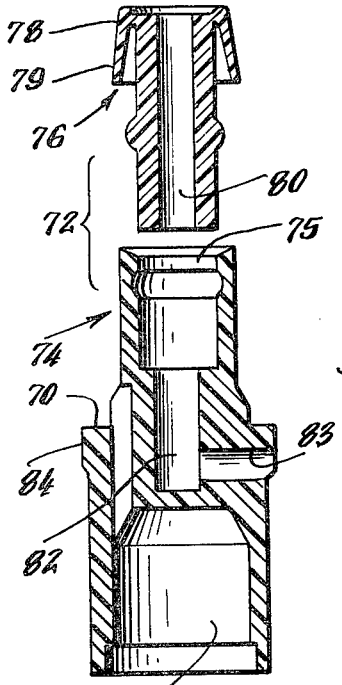
Fig. 5
Fig. 7.
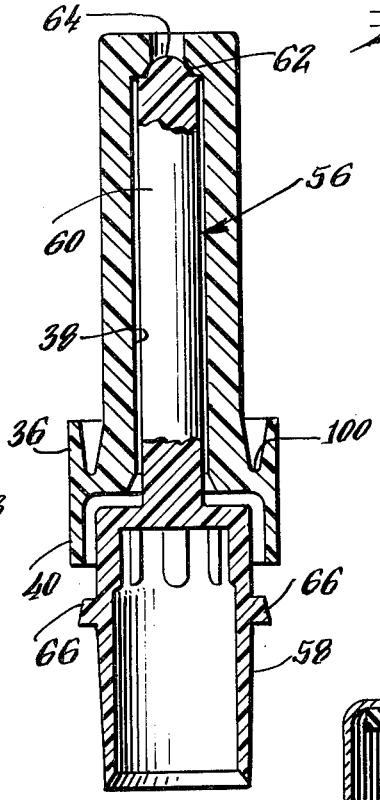
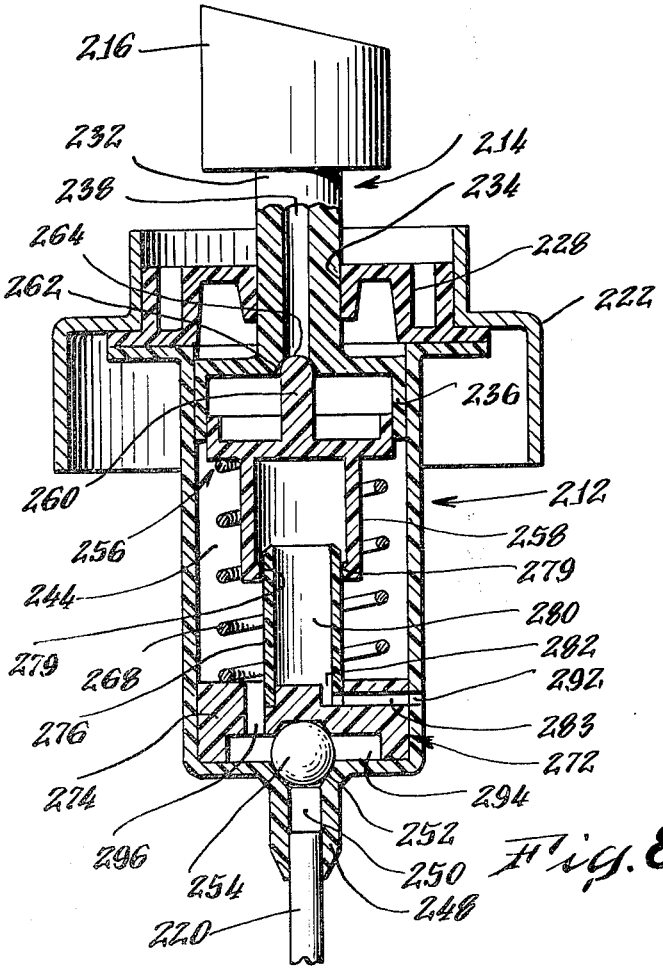
Fig. 8
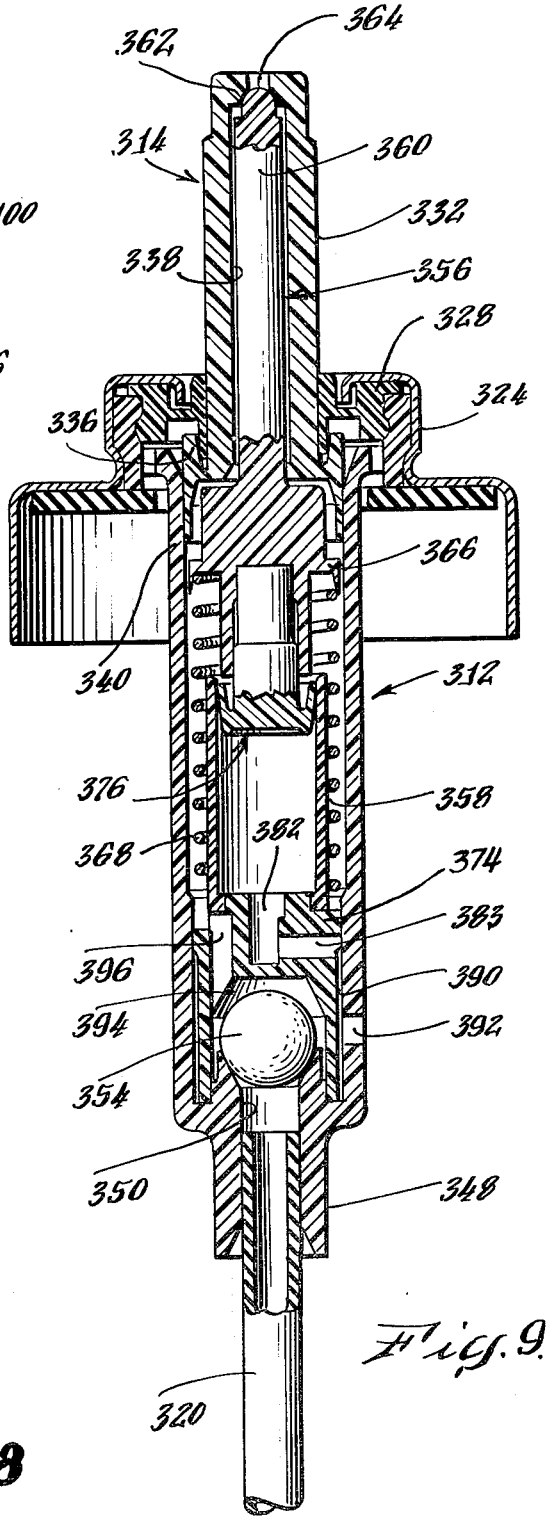
Fig. 9.

NON-THROTTLING MANUALLY RECIPROCATED PLUNGER PUMP FOR CONSUMER-TYPE LIQUID DISPENSING CONTAINERS

RELATED APPLICATIONS

This application is a continuation-in-part of application Ser. No. 873,358, filed Jan. 30, 1978, now abandoned.

BACKGROUND OF THE INVENTION

1. Field of the Invention

The invention relates to a liquid dispensing pump adapted for finger operation when mounted on a consumer-type container to provide a means for dispensing a liquid product from the container. It is a feature of the invention that the pump is so constructed as to produce sharp initiation and cut-off of dispensing flow during reciprocation of the pump plunger in order to avoid dribble on initiating and ending a pumping stroke. Such a pump is referred to herein as a "non-throttling" type.

2. Description of the Prior art

A number of non-throttling pump constructions have been proposed, and some have been used commercially. Those most relevant to the present invention are typified by the construction shown in U.S. Pat. Nos. 3,399,836 (Re. 28,366), 3,627,206, 3,746,260, 3,779,464, 3,923,250, 3,954,354, 4,025,046, 4,029,261 and 4,051,983. Pumps of the type in question involve some complexity of design and fabrication, arising from the conflicting requirements with regard to lowest manufacturing cost consistent with a design giving assurance of reliable dispensing function when operated by the consumer. Some of the problems encountered in attempting to meet these conflicting requirements include difficulty of minimizing the throttling effect during initiation and termination of a plunger stroke; assurred self-priming capability; matching oveall pump miniaturization to maximum requirements of dispensed liquid product. Many of the prior structures incorporate mechanical arrangements such as lost motion connections, differential frictional engagement between parts, and physical intricacy or smallness of certain parts, all of which lead to increased fabrication and assembly costs that tend to remove the final pump product from the category of being a component suitable for consumer-type disposable container use. However there is a large demand for dispensing pumps of this type, especially if they can meet the functional and economic criteria.

SUMMARY OF THE INVENTION

In the embodiment of the invention shown and described in more detail hereinafter, there is provided a specific dispensing pump structure which effectively meets the conflicting requirements involved in providing a commercially acceptable product, both from the merchandisers' as well as the consumers' view points. The novel pump here disclosed provides assured self-priming and effective non-throttling dispenser opeation, as well as minimizing the number of parts and facilitating fabrication and assembly of them, thereby affording advantages over prior similar pump structures.

The novel pump of this invention is characterized by inclusion of a differential force-actuated control element which is carried in nested relation to a hollow-stem pump plunger that is manually reciprocable in a housing defining a pumping chamber. Finger actuation of the plunger against a compression spring produces intake of fluid into the pumping chamber through a dip tube and inlet nipple at one end of the pump housing, and expulsion of fluid from a discharge port in the hollow plunger stem at the other end of the pump housing. The control element prevents discharge of fluid on initiation of a pumping stroke until a predetermined minimum discharge pressure condition has been established and only so long as it is maintained in the pumping chamber, such condition being achieved only so long as the control valve overcomes a closing bias exerted by a plunger return spring, thereby opening the discharge port of the pump. The control valve recloses the discharge port immediately upon termination of each pumping stroke, whether because the plunger reaches the physical limit of its travel or because operating pressure exerted by the consumer on the plunger is intentionally or unintentionally reduced or terminated. The control element incorporates a member physically connected to its discharge port-closing portion, which member is exposed within the pump chamber to pump pressure developed by the plunger. This member assumes either of two different forms in alternate pump structures embodying the invention. In one form the member comprises a cylinder, while in the alternate form the member comprises a piston. A fitment mounted at the inlet end of the pump chamber is provided for cooperation with the aforesaid member, such fitment providing the complementary piston or cylinder and maintaining it in telescoping relation to the control element member throughout reciprocation of the plunger. The fitment additionally provides parallel but separate flow passages at the inlet end of the pump chamber, one passage serving as a fluid duct and inlet check valve housing through which fluid enters the pump chamber from a dip tube extending into the container, the other passage serving as a vent passage for communicating the interior of the cylinder/piston combination with the exterior of the pump housing through an aperture in that housing. A closure is provided at the outlet end of the pumping chamber through which the plunger stem projects, this closure member cooperating with a mounting flange on the pump housing to hold the components in assembled relation, to form a seal about the plunger stem and to provide venting to atmosphere of a container in which the pump is mounted. The venting is arranged to occur only when the plunger is depressed, whereby to maintain a liquid-tight (anti-leak) package under rest or storage condition; i.e. where the plunger is in a "home" position. The aforesaid plunger return spring biases the plunger, and its associated control element, to this home position wherein a peripheral lip of the closure forms a positive liquid tight seal with the plunger stem to prevent leaking in case of inversion of the dispenser package.

The design of the novel non-throttling pump optimizes the configuration of the respective parts for ease of tooling and molding. The result is a highly effective yet economical dispensing pump structure.

BRIEF DESCRIPTION OF THE DRAWINGS

FIG. 1 is a foreshortened elevational view, partly broken away and in section, of a pump assembly of the invention incorporating a spray head, dip tube and mounting ferrule secured to the mouth of a container to complete a dispensing package;

FIG. 2 is a cross sectional view on an enlarged scale of the dispensing pump of FIG. 1, wherein the pump plunger is shown in its normal or "home" position;

FIG. 5 is a detailed cross sectional view of a fitment member received in the lower part of the pump chamber;

FIG. 6 is a detailed view in cross section of a piston forming a second portion of the fitment in the pump chamber;

FIG. 7 shows a sub-assembly, in cross section, of a pump plunger and a floating valve nested in the plunger;

FIG. 8 is a cross sectional view of a modified dispensing pump embodying the invention; and FIG. 9 is a cross sectional view of still another pump structure embodying the invention.

Figure 3:
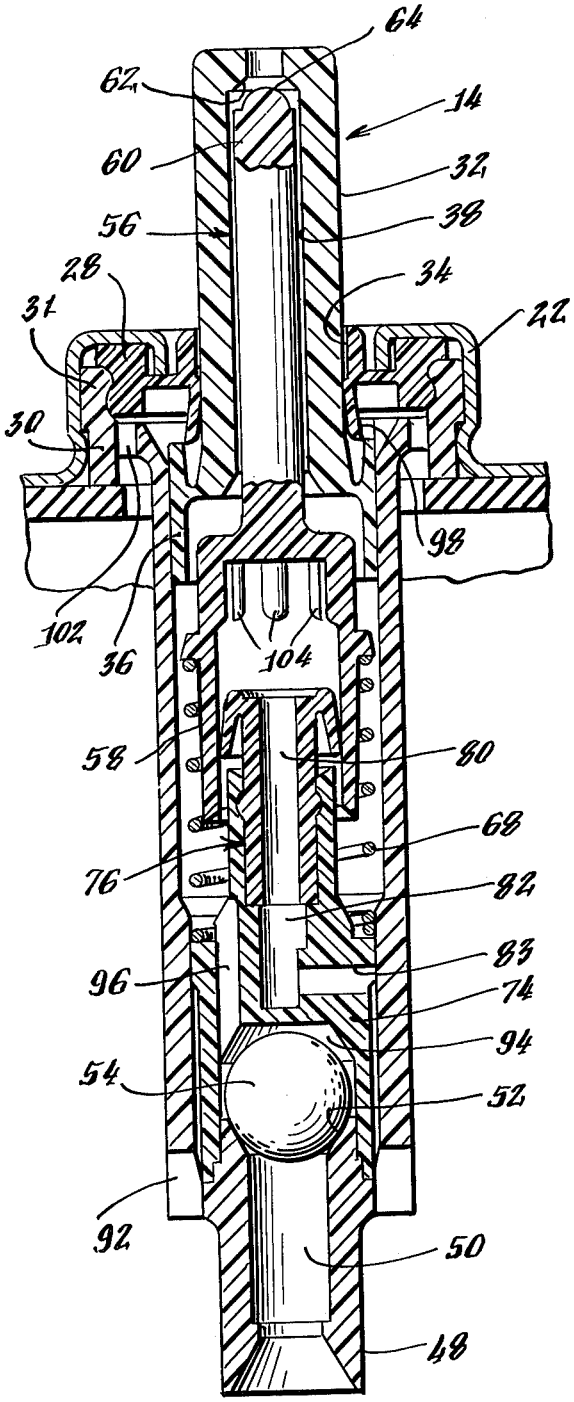
FIG. 3 is a similar cross sectional view, in which the pump plunger has been partially depressed.

The pump 10 illustrated generally in FIG. 1 comprises a pump housing 12, a reciprocable plunger 14 telescopingly received in the housing and carrying a spray head 16 adapted to be engaged on its upper surface by a person's finger. Repetitively depressing the plunger into the housing effects pumping action and dispensing of liquid from a discharge orifice 18 in the spray head. A dip tube 20 is secured in the lower end of the pump housing to communicate the pump with liquid in a container C to which the pump may be attached. Each of the component parts thus far mentioned are preferably formed of molded plastic. In this instance the pump shown is designed for permanent attachment to the mouth of a suitable container, a metal mounting ferrule 22 being provided for this purpose. The pump housing is clamped in the central boss 24 of the ferrule, as by crimping the neck at 25, to hold the pump housing, plunger, and other related components presently to be described, in assembled relation. The ferrule is also adapted to be formed inwardly in its skirt 26, as by rolling to grip a suitably formed lip on the mouth of a container. Obviously an equivalent conventional screw cap or collar, metal or plastic, for demountable connection of the pump to a suitably formed container mouth could be substituted for the permanent attachment arrangement illustrated.

Figure 4:
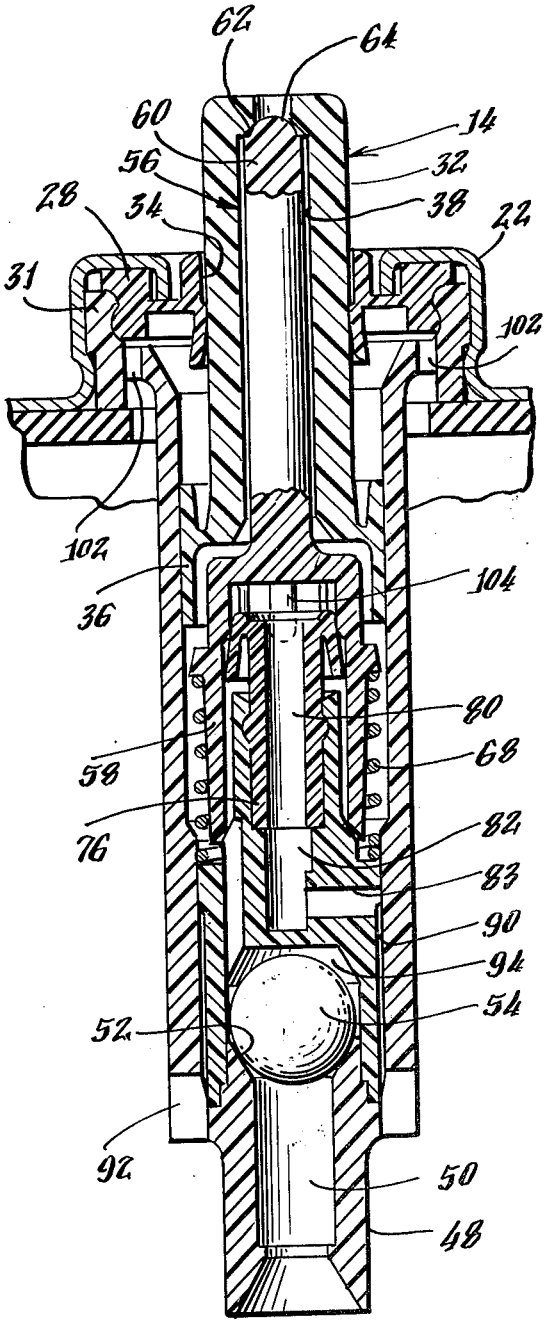
FIG. 4 is a view similar to those of FIGS. 2 and 3 but showing the plunger fully depressed.

Details of the pump construction appear more fully in FIGS. 2 to 4 from which it will be seen that within boss 24 of ferrule 22, a closure collar 28 nests in a flanged enlargement 30 at the upper end of housing 12 constituting a socket in which collar 28 is seated. The collar is clamped to the housing by the neck crimp 25 of ferrule 22 and forms an upper closure member for the pump housing. Pump plunger 14 has a stem 32 which is slidably received in a central aperture 34 of collar 28 and projects axially upwardly above the ferrule a distance sufficient to enable a user to depress plunger 14 into pump housing 12 adequately to effect pumping action. Plunger 14 is formed with an enlarged head or piston 36 which is preferably integral with stem 32, and both the head and stem are hollow so as to provide a fluid discharge passage 38 leading outwardly from housing 12 to the spray head 16. The side wall or skirt 40 of the piston is resilient, and the outer surface of skirt 40 if preferably tapered outwardly toward its free edge to provide a piston fit with the inner wall 42 of housing 12 during reciprocation of the plunger. Inner wall 42 thus laterally defines a pump chamber 44 which is closed at its upper axial end by the piston 36 and collar 28, and at its lower end by end wall 46 of housing 12. This end wall incorporates a nipple 48 in which dip tube 20 is frictionally received, and an inlet passage 50 provides communication from the dip tube into pump chamber 44. A valve seat 52 is formed in end wall 46 within the chamber at the opening thereon of inlet passage 50, and a check valve member, such as ball 54, cooperates with the seat to permit inflow of liquid from inlet passage 50 to chamber 44, while preventing return flow out of the chamber and inlet passage.

Associated with plunger 14 is a floating, differential force-actuated, control element 56 having a lower, hollow cylinder or body portion 58 of somewhat lesser diameter than piston 36 of the plunger, thereby enabling cylinder 58 to nest loosely within the skirt 40 of the piston. A rod 60 extends upwardly from cylinder 58, being of sufficiently smaller cross section than discharge passage 38 in the plunger as to leave adequate room for fluid flow between the rod and wall of the passage to allow for delivery of fluid to the spray head 16. At its upper end, the discharge passage 38 in plunger stem 32 is formed to provide an internal valve seat 62, and the length of rod 60 is so coordinated with the length of discharge passage 38 that the tip 64 of the rod seats against internal valve seat 62 immediately before cylinder 58 bottoms on the plunger head. Tip 64 of rod 60 is formed to serve as a mating valve member for internal valve seat 62, and to shut off fluid discharge from passage 38 to the spray head 16 when element 56 is in fully telescoped (bottomed) condition in the plunger. Such condition is the one illustrated in FIGS. 2 and 4. Cylinder 58 is formed with an external shoulder 66, and a coiled compression spring 68 encircles the cylinder to abut at its upper end against the shoulder. The lower end of spring 68 reacts against an annular shoulder 70 of a fitment member 72 received in the bottom of pump chamber 44 and described more fully presently. Thus control element 56 is normally biased upwardly to seat discharge valve member 64 on valve seat 62, thereby also biasing plunger 14 to its axially upper position; that is, its rest or home position. Depression of plunger 14 is resiliently opposed by reaction of coil spring 68 through control element 56 which moves with corresponding movement of the plunger but is also capable of relative axial movement independently, as will appear more fully presently. Fitment 70 is here illustrated as a two-part structure of generally cylindrical form comprising a base 74 and a piston 76. See FIGS. 5 and 6 for detail. Piston 76 is designed in its head portion 78 to make a close sliding fit with the inner wall of the cylinder portion 58 of control element 56 throughout most of its axial extent, and a peripheral lip 79 facilitates such a fit. A vent passage 80 extends axially through the piston to make connection with further vent passages 82, 83 in base 74.

Base 74 is received in the lower end of pump chamber 44, in abutting relation to end wall 46 of that chamber. An intermediate annular flange 84 on the side wall of the base forms a fluid tight fit with the enclosing side wall of chamber 44; however, the side wall has an annular undercut portion 86 below flange 84 so that in assembled position base 74 provides an annular passage 90 between the fitment base and pump chamber wall. Passages 82, 83 of the base open into passage 90, as also does aperture 92 in housing 12, thereby establishing venting communication between the interior of cylinder 58 and the exterior of the pump housing.

The upper portion of fitment base 74 within which socket 75 is located is of reduced diameter relative to the rest of the base, allowing it to extend axially within coil spring 68 and leaving annular shoulder 70 of the base to serve as a footing for the lower end of the return spring. Base 74 is counterbored in its lower end to provide a cage 94 which loosely receives and retains check valve ball 54 in proper relation to its seat 52. Communication between cage 94 and pump chamber 44 is provided by a separate passage 96 leading into pump chamber 44 above shoulder 70.

In its home position plunger 14 makes a fluid tight fit in aperture 34 of collar 28, this being accomplished by a tapered or frustoconical section of the plunger stem 32 immediately adjacent its junction to piston 36. This is supplemented by a resilient lip formation 98 surrounding aperture 34 on the inner face of collar 28. The wedging action between formation 98 and plunger stem 32 in the home position is also supported by a frustoconical recess 100 in the upper annular surface of piston 36, which has the effect of squeezing lip 98 between the plunger stem and the sloping wall of recess 100 of the piston.

Venting of the container C in which the pump is mounted, at times other than when plunger 14 is in its home position, is provided by slight clearance between plunger stem 14 and sleeve formation 98 and by vent passages 102 in the flanged enlargement 30 forming the upper rim of housing 12. These passages may also be formed by castellations 31 in the lip of the flange.

FIGS. 3 and 4 illustrate, respectively, plunger 14 at an initial stage of depression and full depression from rest position. As will be described more fully, depression of the plunger initially causes control element 56 to move axially downward with plunger 14. However, a net force differential is developed by pressure on control element 56, thereby causing rod tip 64 to move away from seat 62 and thus open discharge passage 38 to permit outflow of fluid from pump chamber 44. When plunger 14 is fully depressed, as seen in FIG. 4, or when depression of the plunger is stopped for any other reason, the conditions prevailing in the pump chamber cause valve members 62, 64 to again close and shut off fluid discharge. In addition, in the position shown in FIG. 4, lip 79 on piston 76 engages circumferentially discontinuous ramps 104 formed on the inner surface of cylinder 56 at its closed end. This produces a radial inward deflection of lip 79 which interrupts the piston fit between the members and allows restricted communication between pump chamber 44 and central passage 80 of sleeve 76. The arrangement just described affords more immediate and positive initial priming of the pump.

The pump functions in the following manner. Assume pump assembly 10 is mounted in the mouth of a suitable container containing a liquid product to be dispensed; assume also that the pump has not previously been operated and is therefore not primed. Accordingly, fluid will only rise to some level in dip tube 20 below the level in the container, and all of the various passages within the pump housing, plunger and spray head will be filled with air at this time.

When the user then depresses plunger 14, piston head 36 of the plunger as well as control element 56 will both be moved down simultaneously within pump chamber 44. Air trapped within cylinder 58 of the control element will be forced out through piston 76, passages 82, 83 and 90 and aperture 92 into the container. This may have some tendency to force liquid in the container to rise in dip tube 20, but since venting of the container can take place whenever plunger 14 is moved out of its home position, this initial exhausting of the air from the control cylinder is unlikely to force the liquid to rise in the dip tube. In any event it will not rise sufficiently to unseat inlet check valve ball 54 since this will be under the influence of air pressure in chamber 44 developed by piston 36 of plunger 14. Air in this pump chamber will not enter dip tube 20 because of check ball 54. Since the air is relatively easily compressed, the pressure developed in pump chamber 44 during the priming stage may not operate the control element to open the discharge valve. Accordingly, the auxiliary venting arrangement provided by ramps 104 when piston 76 is bottomed in cylinder 58, as described above, serves more positively to allow relief of the air compressed by plunger 14 at this stage of operation. This ensures exhausting of pump chamber 44 so that upon releasing the plunger to allow the latter to start to return to its home position under the action of the spring, the plunger piston will thereupon produce a negative pressure in pump chamber 44, sucking liquid from dip tube 20 past check ball 54 into the chamber. Upon arrival of plunger 14 to full rest (home) position, liquid in chamber 44 will not then escape back into the container because of check ball 54.

Subsequent cycles of plunger depression from and to home position will again cause a repetition of the conditions described above; but in this case, since the pump chamber now contains liquid rather than air, a positive differential force will be developed on control element 56 to ensure opening of the discharge valve 62, 64. Such positive differential force is produced because of difference in diameter (areas) between plunger piston 36 acting in chamber 44, and sleeve piston 76 acting in cylinder 58 of the control element 56. Since the diameter of piston 36 is greater than that of sleeve piston 76, the total force developed by pump piston 36 will act upon the smaller piston/cylinder combination 76, 58 of the control element. The resulting force on the element produces a differential, overcoming the counteracting force of return spring 68 and allowing control element to move down relative to plunger 14. This will open discharge valve 62, 64 and eject fluid out through discharge orifice 18 of spary head 16. As will be apparent from the foregoing, discharge of liquid from the spray head cannot occur until the pressure value or level in the pumping chamber has reached a point sufficient to move the control element out of shut-off condition. Thus, the rate of discharge of liquid at the spary head does not build up gradually as the pumping stroke continues, and drip at the spray head due to initial low flow rate is avoided. Similarly, whenever the pumping action is interrupted or slowed down, the differential force causing control element to open discharge valve 62, 64 disappears and there is immediate shut-off of discharge. Again, drip at the nozzle, due to gradual decrease in flow rate, is avoided.

A pump structure of modified design is shown in FIG. 8. In major respects the component parts of this design correspond to those of the pump described above, and parts are accordingly identified by corresponding reference numerals bearing a 200-series designation. Thus pump 210 has a housing 212 and a reciprocable plunger 214 carrying an actuator-spray head 216. Housing 212 is open at its upper end and is adapted to receive a closure member or collar 228 having a central aperture 234 through which plunger stem 232 projects for guided reciprocation. A control element 256 has a lower cylinder portion 258 and a rod 260 extending axially up therefrom into engagement with an internal valve seat 262 in plunger head 236 surrounding discharge passage 238 in the plunger stem. This pump also includes a fitment member 272 composed of a base 274 supporting an axially oriented sleeve piston 276 which extends upwardly into telescoping relation to cylinder 258 of control member 256, making a sliding fit therewith by virtue of an internal lip formation 279 formed in this case on the rim of cylinder 258. Fitment 272 fits tightly in the bottom of pump chamber 244 and is provided on its undersurface with a recess defining a cage 294 for inlet check valve ball 254 which cooperates with valve seat 252 surrounding inlet 250 in the closed end of the pump housing. Fitment 272 has vent passages 282, 283 which communicate the central passage 280 and sleeve piston 276 with the outside of pump housing 212 via an aperture 292 formed in the wall of the housing. Base 274 of the fitment also incorporates a fluid passage 296 communicating the check ball cage and pump chamber 244. Fluid passage 296 is again separate from vent passage 282 and makes no connection therewith.

Coil member 268 is located in the pump chamber, surrounding control element cylinder 258 and sleeve piston 276, being held in compression between control element 256 and fitment 272. This biases the control element against plunger 214, normally positioning it in its axially extended position and closing discharge valve members 262, 264. The various components are held in this assembled condition by a ferrule 222 which serves also to mount the assembly to the mouth of a suitable container, as heretofore described.

Operation of pump 210 is functionally the same as that of the previously described pump 10 except that in this case no separate provision is made for initial venting of pump chamber 244 to the interior of cylinder 258, such as is provided by ramps 104 of the preceding pump structure. Here venting occurs by leakage between lip 279 of cylinder 258 and sleeve 276, arising from normal manufacturing tolerances.

A still further embodiment of the invention is illustrated in FIG. 9. Again the major components of this pump correspond generally to those of the pumps already described, and parts are accordingly identified by corresponding reference numerals bearing a 300-series designation. This pump also functions in the same manner as the preceeding ones. The principal difference in construction is that the relative positions of the cooperatively telescoping cylinder and piston of the control element and fitment or body insert are respectively reversed. In the embodiment shown in FIG. 9, control element 356 carries piston 376, while fitment 374 supports cylinder 358. Slight internal enlargement of the cylinder circumference, adjacent its point of attachment to the fitment, serves as the equivalent of the inner nibs 104 of the arrangement in FIGS. 2–4, to allow leakage or by-passing of air between piston 376 and cylinder 358 when in fully telescoped relation. This facilitates the priming of the pump, as mentioned previously.

Although specific embodiments of the present invention have been described above in detail, it is to be understood that these are for purposes of illustration only. Modifications will be apparent to and may be made by those skilled in the art to adapt pumps embodying the invention claimed herein to particular applications.

What is claimed is:

1. In a manually reciprocable pump for dispensing containers;

a housing forming a pump chamber and having provision for fluid intake at one end and discharge at the other, the chamber being open at the discharge end and closed at the intake end;

a fluid inlet formed in the closed end, and an inlet valve seat formed interiorly of said chamber about said inlet;

check valve means coacting with said inlet seat permitting entry of fluid through said inlet into said pump chamber and preventing reverse flow therefrom;

a plunger disposed in said pump chamber for reciprocation therein, said plunger having a skirted hollow head making a sliding piston fit with the wall of the chamber, said plunger including a hollow stem secured to said head and extending axially outwardly of the open end of said chamber to provide a discharge passage therefrom;

a closure member at the open end of said housing, said closure member having a central aperture through which said plunger stem projects axially and which guides said stem during reciprocation, said closure member limiting outward movement of said plunger by abutment of its head against said closure member;

a discharge outlet in said stem passage and a valve seat formed at the upstream side of said discharge outlet;

a differential force actuated control element having a hollow body of lesser diameter than said plunger head and adapted to nest concentrically therewith at its downstream side, said element having a rod secured in it to project axially into said hollow plunger stem in radially spaced relation thereto, said rod having a valve member at its upper end which coacts with the valve seat in said plunger stem to close said discharge outlet;

a compression spring interposed between the closed end of said pump chamber and said control element and biasing its valve member against said plunger valve seat, thereby simultaneously biasing said plunger towards fully extended position in abutment with said housing closure member, said control element moving with said plunger when the plunger stem is manually depressed against said compression spring but capable of independent axial movement relative thereto under influence of pumping pressure in the chamber;

a fitment disposed adjacent said inlet at the closed end of said pump chamber, said fitment and said control element respectively supporting one member of a cylinder/piston combination arranged axially in telescoping relation within said pump chamber and adapted to maintain a piston/cylinder fit throughout full reciprocation of said pump plunger;

a port in said pump housing wall adjacent said fitment and said fitment having a passage which communicates the interior of said cylinder/piston combination with said port, said fitment having a separate passage which communicates said pump chamber with said fluid inlet.

2. A manually reciprocable dispensing pump as defined in claim 1, wherein a resilient lip formation is formed on one of said cylinder/piston combination members to facilitate maintaining said sliding piston/-cylinder fit between them.

3. A manually reciprocable dispensing pump as defined in claim 2, wherein one of said cylinder/piston combination members is formed with circumferentially discontinuous ramp means which are engaged in the fully depressed position of said pump plunger to flex said resilient lip formation radially to loosen said piston-cylinder fit between them.

4. A manually reciprocable dispensing pump as defined in claim 2, wherein said cylinder member of said cylinder/piston combination is tapered to enlarge the cylinder diameter in the position occupied by the piston when in fully telescoped relation to said cylinder.

5. A manually reciprocable dispensing pump as defined in claim 1, wherein said fitment includes a chamber forming, with said closed end of said pump housing, a valve cage which confines said inlet check valve means disposed thereat.

6. A manually reciprocable dispensing pump as defined in claim 5, wherein said fitment comprises a base defining at its underface said valve cage and the piston member of said cylinder/piston combination; said complementary cylinder member of said cylinder/piston combination being supported in said control member.

7. A manually reciprocable dispensing pump as defined in claim 5, wherein said fitment comprises a base defining at its underface said valve cage and the cylinder member of said cylinder/piston combination; said complementary piston member of said cylinder/piston combination being supported in said control member.

8. A manually reciprocable dispensing pump as defined in claim 1, wherein said closure member for the open end of said housing is formed with a resilient peripheral lip about its central aperture which makes a sliding seal with said plunger stem in the fully extended position of the latter, said stem being tapered above its junction with said skirted head of said plunger to provide clearance between said stem and collar at positions of said plunger other than its fully extended one.

9. A manually reciprocable dispensing pump as defined in claim 8, wherein said skirted head of said plunger is provided on its upper surface with a formation which contacts said lip of said closure member in the fully extended position of said plunger to wedge said lip against said plunger stem.

10. In a manually reciprocable dispensing pump for consumer-type dispensing containers;

a rigid tubular housing forming a pump chamber and having provision for fluid intake at one end and discharge at the other, the chamber being open at the discharge end and closed at the intake end;

a fluid inlet formed in the closed end, and an inlet valve seat formed interiorly of said chamber about said inlet;

a ball-type check valve coacting with said inlet seat permitting entry of fluid through said inlet into said pump chamber and preventing reverse flow therefrom;

a plunger disposed in said pump chamber for reciprocation therein, said plunger having a skirted hollow head making a piston fit with the wall of said pump chamber, said plunger further including a hollow steam secured to said head to extend axially outwardly of the open end of said pump chamber to provide a fluid discharge passage therefrom;

a collar forming a closure member at the open end of said tubular housing, said collar having a central aperture through which said plunger stem projects axially and which guides said stem during reciprocation, said collar limiting outward movement of said plunger by abutment of said plunger head against said collar;

a discharge outlet formed in said hollow plunger stem and a valve seat formed in said discharge outlet;

a control element having a hollow body of lesser diameter than said plunger head and nested concentrically therein at the downstream side thereof, said element comprising a cylinder portion open at its downstream end, said element also having a rod secured to project axially upwardly from the closed end of said cylinder portion, said rod having at its outer end a formation which coacts with said valve seat in said plunger stem to close said discharge outlet;

a coiled compression spring surrounding said control element and interposed between it and the closed end of said pump chamber, thereby biasing said control element against said plunger to maintain said rod formation normally against its seat in said plunger and to maintain said plunger normally in fully extended position in abutment with said collar, said control element moving with said plunger when the latter is manually depressed but being capable of independent axial movement relative thereto under influence of pumping pressure in the chamber;

a cylindrical fitment in the inlet end of said pump chamber, said fitment having a base portion making a fluid tight fit circumferentially of said chamber wall, said fitment also having an axially oriented sleeve piston of smaller diameter than said base portion and projecting upwardly into said pumping chamber for telescoping engagement with said cylinder portion of said control element and making a sliding piston fit therein, said fitment having a recess on its under surface which coacts with the end wall of said pump housing to form a cage for said ball-type check valve and a fluid passage in said fitment communicating said cage with said pump chamber, said pump housing having a vent aperture in its side wall adjacent said fitment and said fitment having separate vent passages communicating said housing aperture to said sleeve portion.

* * * * *